United States Patent [19]

Ito et al.

[11] Patent Number: 4,975,664

[45] Date of Patent: Dec. 4, 1990

[54] FILTER DEVICE

[75] Inventors: Kenji Ito; Hiroyuki Shimizu, both of Nagoya, Japan

[73] Assignee: NGK Spark Plug Co., Ltd., Nagoya, Japan

[21] Appl. No.: 329,312

[22] Filed: Mar. 27, 1989

[30] Foreign Application Priority Data

Mar. 30, 1988 [JP] Japan ..... 63-79981

[51] Int. Cl.[5] ..... H01P 1/203

[52] U.S. Cl. ..... 333/205; 333/204; 333/235

[58] Field of Search ..... 333/203, 204, 205, 219, 333/238, 246, 235, 207, 202

[56] References Cited

U.S. PATENT DOCUMENTS

| | | | |
|---|---|---|---|
| 4,157,517 | 6/1979 | Kneisel et al. | 333/205 |
| 4,266,206 | 5/1981 | Bedard et al. | 333/204 |
| 4,785,271 | 11/1988 | Higgins, Jr. | 333/204 |
| 4,837,534 | 6/1989 | Van Horn | 333/223 X |

FOREIGN PATENT DOCUMENTS

| | | | |
|---|---|---|---|
| 0263702 | 11/1987 | Japan | 333/204 |

*Primary Examiner*—Eugene R. LaRoche
*Assistant Examiner*—Seung Ham
*Attorney, Agent, or Firm*—Brady, O'Boyle & Gates

[57] ABSTRACT

A filter device of a three-conductor structure type having a stripline pattern resonator consisting of a plurality of juxtaposed resonator conductors between two dielectric substrates which are stacked to each other, each of said dielectric substrates being provided with an outer conductor layer which surrounds the the outer surface and side portion thereof and is connected to one ends of the juxtaposed resonator conductors, and openings for adjusting the frequency of response of the filter, each frequency adjusting opening being provided on the lateral portions of the outer conductor layers corresponding to said one end of the each resonator conductor. A conductor strip for increasing the frequency of response of the filter can be removably applied to each frequency adjusting opening.

7 Claims, 3 Drawing Sheets

FILTER DEVICE

BACKGROUND OF THE INVENTION

The present invention relates to a filter device of a three-conductor structure type adapted for use miniature electronic circuits.

There is known a filter device of a three-conductor structure type in which a stripline pattern is disposed between contact surfaces of two dielectric substrates stacked and comprises a plurality of juxtaposed resonator conductors. Such a filter device is of small size and simple, and thus is preferably used in the miniature electronic circuits.

Generally, the conventional filter device of a three-conductor structure type has a frequency response which depends on the size of the resonator conductors, the structure of an external conductor to which the resonator conductors are connected, the configuration and dielectric constant of the substrates or other factors. Therefore, if there are any dispersions in the configuration and dielectric constant of the substrates or the like, the frequency response of the filter may substantially be varied so that it may be deviated from a predetermined frequency range.

In order to avoid the disadvantage, that is, to maintain the frequency response characteristic of the filter within the predetermined frequency range, it has been proposed to use adjusting screws or adjusting devices such as external capacitors. A clamping devices have also been provided for compressing the dielectric material so as to change the electrical parameters of the resonator conductors.

However, the provision of the adjusting means results in the increased size and cost of the filter and therefore these various adjusting means have not always been effective or satisfactory.

On the other hand, a solution to the problem mentioned above is disclosed in U.S. Pat. No. 4,157,517 issued June 5, 1979 to Thomas F. Kneisel et al. In the filter disclosed in this patent, an external conductor provided on the upper surface of an upper substrate is partially removed at a portion positioned above a resonator conductor to reduce the capacitance between the external conductor and the resonator conductor thereby making it possible to adjust the frequency.

With this arrangement, however, since a casing for containing the filter comes into close contact with the upper and lower external surfaces of the filter to reduce the height of the casing, the dielectric substrate comes into direct contact with the casing via the removed portion of the external conductor or an opening. Therefore, after adjusting and assembling of the filter, the distributed capacity may be varied so that the frequency may be deviated.

SUMMARY OF THE INVENTION

It is therefore an object of the present invention to provide a filter of a three-conductor structure type capable of compensating any variation in the frequency which may occur when the filter is contained in a casing.

Another object of the present invention is to provide a filter device which fully meets with the requirement for smaller and thinner dimensions of the miniature electronic circuits.

According to the present invention, there is provided a three-conductor type filter comprising two dielectric substrates which are stacked to each other, a stripline pattern resonator including a plurality of juxtaposed resonator conductors and disposed on the surface of one of said dielectric substrates which is brought into contact with the other dielectric substrate, outer conductor layers each formed on each of said dielectric substrates so that it surrounds the outer surface and side portion of said each dielectric substrate, said outer conductor layer formed on said one dielectric substrate being connected to one ends of said juxtaposed resonator conductors, and openings each provided on the lateral portions of said outer conductor layers corresponding to said one end of the each resonator conductor for lowering the frequency of response of the filter.

Each opening may be provided with a removable conductor strip for increasing the frequency of response of the filter.

It has been found that the provision of the openings on the side portions of the outer conductor layers causes the response frequency of the filter to be reduced. This is contrary to the prior art in which a portion of a ground plane conductor is removed to provide an opening, for example, as disclosed in said U.S. Pat. No. 4,157,517 because the response frequency of the filter is increased by removing the portion of the ground plane conductor.

Therefore, according to the present invention, if the center frequency of the filter is shifted toward the higher frequency side, said opening(s) is formed to reduce the frequency. To the contrary, if the center frequency of the filter is shifted toward the lower frequency side, a conductor stripe is applied to the formed opening(s) to shift the center frequency toward the higher frequency side.

The frequency adjusting openings are provided on the side portions of the filter body, so that the outer surfaces of the filter body can be brought into contact with the inner surfaces of a casing without making any trouble.

A suitable space may be maintained between the each opening and the opposite lateral wall of the casing without causing the total thickness or height of the filter to increase.

The present invention will now be described by way of example with reference to the accompanying drawings:

DETAILED DESCRIPTION

Figure 1:
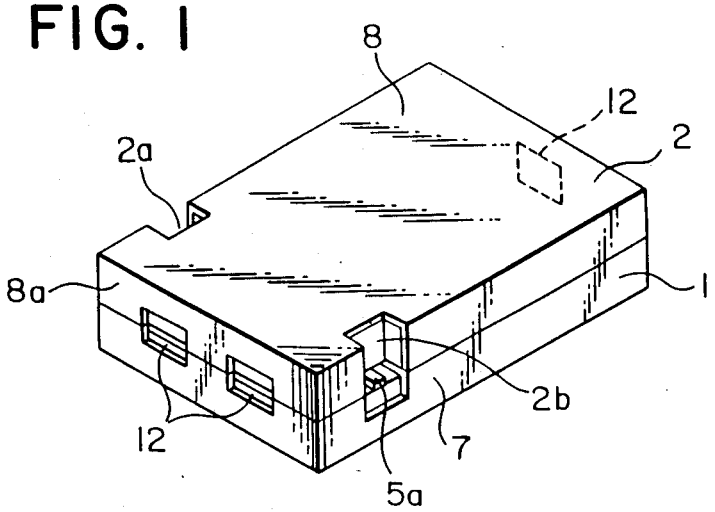
FIG. 1 is a perspective view schematically showing a filter according to an embodiment of the present invention.
Figure 2:
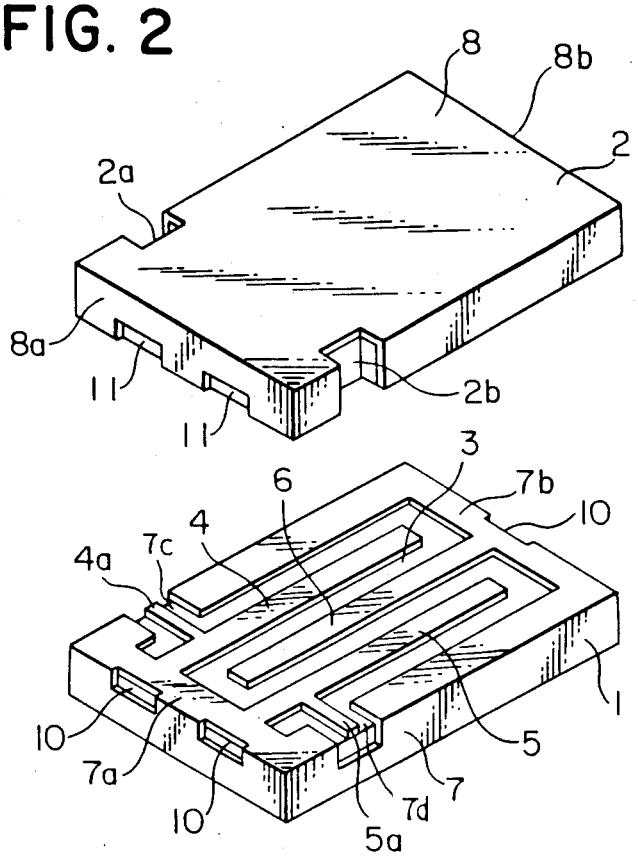
FIG. 2 is an exploded perspective view of the filter shown in FIG. 1.

FIGS. 1 and 2 illustrate a filter of a three-conductor structure type according to an embodiment of the present invention.

The illustrated filter comprises a lower and upper dielectric substrates 1 and 2 which are to be stacked to each other upon the assembling of the filter. The lower dielectric substrate 1 has one surface provided with a stripline pattern resonator 3 which includes three resonator conductors 4, 5 and 6 juxtapositionally interdigitated. Each of the resonator conductors 4, 5 and 6 has a length set to substantially one quarter of the wavelength of an intended resonance frequency of the resonator 3. An outer conductor layer 7 is provided on the other surface and peripheral portion of the lower dielectric substrate 1, and is extended about the edge portion of the one surface thereof so as to substantially surround the juxtapositionally interdigitated resonator conductors 4, 5 and 6. As shown in FIG. 2, also, the outer conductor layer 7 is integrally connected to the one end of each of the resonator conductors 4, 5 and 6. The other end or open circuit end of each resonator conductor is spaced from the associated edge portion 7*a* or 7*b* of the outer conductor layer 7. The outer conductor layer 7 has notches 7*c* and 7*d* for forming clearances for lateral extensions 4*a* and 5*a* of the outer conductor layer 4 and 5, respectively. One of the extensions 4*a* and 5*a* is formed as a signal input electrode and the other extension is formed as a signal output electrode.

The upper dielectric substrate 2 to be stacked onto the lower dielectric substrate 1 is provided with an outer conductor layer 8 on the upper surface and peripheral portion thereof. The outer conductor layer 8 is electrically connected to the outer conductor layer 7 of the lower dielectric substrate 1 when being assembled.

The upper dielectric substrate 2 has grooves 2*a* and 2*b* which are positioned corresponding to the lateral extensions 4*a* and 5*a* on the lower dielectric substrate 1. These grooves 2*a* and 2*b* may be provided to be accessible when the signal input and output electrodes 4*a* and 5*a* or 5*a* and 4*a* are connected to an input and output conductors connected with a circuit board, not shown.

The outer conductor layers 7 and 8 on the lower and upper dielectric substrates 1 and 2 are provided with notches 10 and 11 at regions corresponding to the one ends of the respective resonator conductors 4, 5 and 6, respectively. These notches 10 and 11 form rectangular openings 12 for adjusting the frequency response of the filter when the lower and upper dielectric substrates 1 and 2 are assembled. The notches 10 and 11 may be formed by printing the outer conductor layers 7 and 8 on the lower and upper dielectric substrates 1 and 2, respectively, excepting said regions, or removing the outer conductor layers 7 and 8 at said regions by means of a cutting tool, a laser beam machining, a sand blasting or the like.

Figure 3:
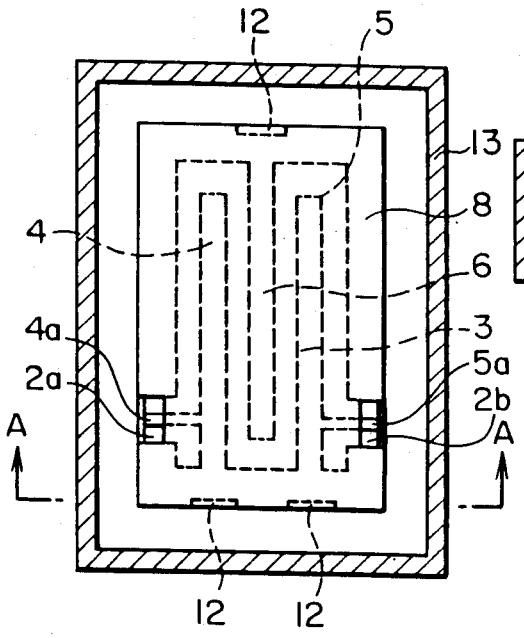
FIG. 3 is a partial longitudinal section showing the filter contained in a casing.
Figure 4:
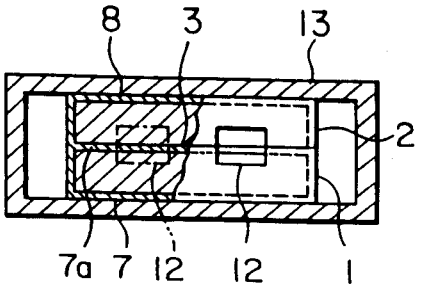
FIG. 4 is a cross section of the filter device taken along the line A—A of FIG. 3.

Filter thus constructed is contained in a casing 13 as shown in FIGS. 3 and 4. The casing 13 may be formed of metal, and has an inner height equal to the height of the filter and a width larger than that of the filter. By selecting the dimension of the casing 13 in this way, the filter device can be substantially restrained from being increased in its height direction, and the peripheral portion of the filter including the openings 12 can be prevented from bringing into contact with the inner surface of the casing 13.

With the illustrated filter device mentioned above, by providing the openings 12 on the filter the center of the response frequency thereof is adjusted toward a lower direction. Therefore, if the center frequency of the filter is higher than an intended reference level, the correction can be performed by providing the openings 12. On the other hand, if the center frequency is lower that the intended reference level, the correction can be performed by applying a conductor strip to each opening 12.

Alternatively, the conductor strip may previously be applied to each opening 12 upon the manufacturing of the filter. In this case, the response frequency of the filter is corrected by peeling off the conductor strip applied to the each opening 12.

In the illustrated embodiment, the resonator conductors 4, 5 and 6 may be arranged in a comb shape to be extended from the same edge portion 7*a* or 7*b* of the outer conductor layer 7. Also, the upper dielectric substrate 2 may be provided with a transmission line pattern on the lower surface, which is disposed to have a reflected image relation with respect to the stripline pattern 3 on the lower dielectric substrate 1. When being assembled the stripline pattern 3 on the lower dielectric substrate 1 comes into face-to-face contact with the transmission line pattern on the upper dielectric substrate 2 without occurring any gaps between the stripline pattern 3 and the upper dielectric substrate 2.

With the illustrated filter device, in order to stably retaining the filter in the casing, the inner side walls may be brought into contact with the lateral surfaces of the filter including the adjusting openings.

Figure 5:
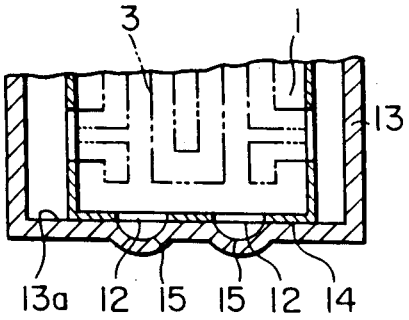
FIG. 5 is a section showing a portion of a filter device according to another embodiment of the present invention.

As shown in FIG. 5, the inner length of the casing 13 is determined to be equal to the length of the filter so that both inner end walls (only one of which is represented by 13*a* in FIG. 5) of the casing 13 come into contact with the end surfaces (only one of which is represented by 14 in FIG. 5) of the filter. Each of the inner end walls is outwards protruded at region(s) opposite to the opening(s) 12 so as to form inner recess(es) 15, thereby preventing the portions of the dielectric substrates 1 and 2 exposed through each opening 12 from bring into contact with the associated inner end surface of the casing 13.

Figure 6:
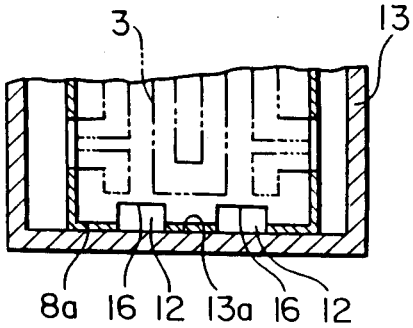
FIG. 6 is a section showing a portion of a filter device according to a further embodiment of the present invention.

FIG. 6 shows a further embodiment in which rectangular recesses 16 are provided on the portions of the dielectric substrates 1 and 2 which are opposite to the respective openings 12. The portions of the dielectric substrates 1 and 2 exposed through each opening 12 can be prevented from bring into contact with the associated inner end surface of the casing 13 when the filter is inserted into the casing 13 so that the inner end surfaces 13*a* abut the outer conductor layers 7 and 8.

In this way, since it can be avoided that the exposed portions of the lower and upper dielectric substrates 1 and 2 are brought into contact with the inner surfaces of the casing 13 when the filter is inserted into the casing 13, the frequency of the filter adjusted by means of the openings of the outer conductor layers is not varied and thus the readjustment of the frequency characteristic of the filter is not required upon the completion of the filter device.

Figure 7:
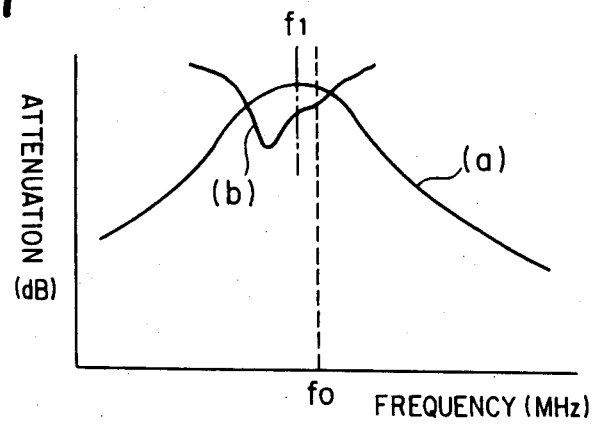
FIGS. 7 and 8 are graphes showing the frequency responses of the filter when being not adjusted.
Figure 8:
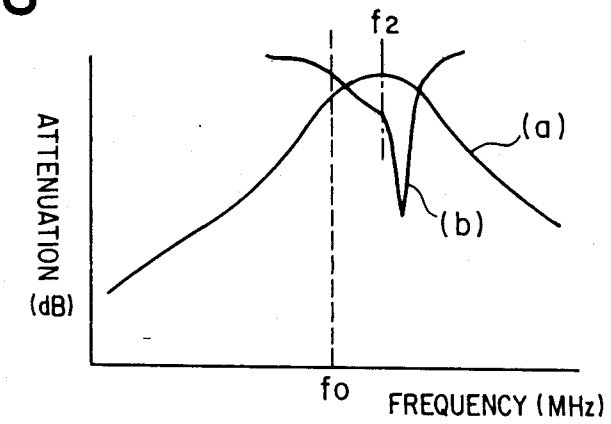
Figure 9:
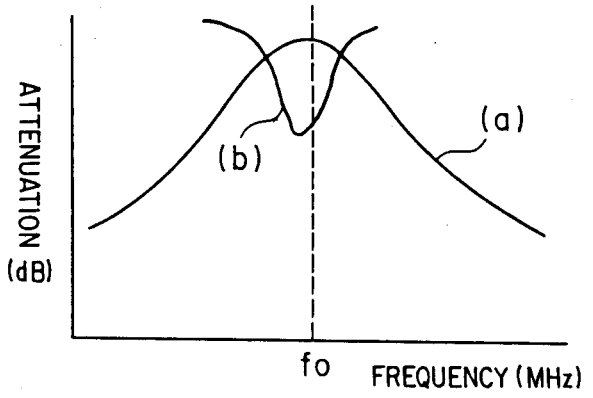
FIG. 9 is a graph showing the frequency response of the filter adjusted in accordance with the present invention.

FIGS. 7, 8 and 9 show respectively the transmission and reflection characteristics (a) and (b) of the filter.

FIG. 7 shows the case that the center frequency f1 of the filter is shifted to the low frequency side of a desired center frequency f0. In this case, by applying the conductor strip to each opening provided on the outer conductor layers the deviation of the center frequency f1 of the filter can be corrected so that the center frequency f1 corresponds to the desired center frequency f0 as shown in FIG. 9.

As shown in FIG. 8, if the center frequency f1 of the filter is shifted to the high frequency side of a desired center frequency f0, this deviation can be corrected by providing the openings on the outer conductor layers or by peeling off the conductor strips previously applied to the openings.

As described above, with the filter device according to the present invention frequency adjusting openings are provided on outer conductor layers at regions corresponding to one ends of resonator conductors for adjusting the center frequency of the filter toward the low frequency side. As compared with the conventional filter device in which an outer conductor of a filter is removed at regions which are to be abutted on the inner surface of a casing, the filter device of the present invention has an advantage that there is no variation or deviation in the set frequency characteristic of the filter when the filter device is completed by inserting the filter into the casing. Further the present invention has also an advantage that a frequency adjustment can be easily and correctly made without substantially increasing the thickness or height of the casing, thus contributing to miniaturization of a filter circuit apparatus.

It is to be understood that the above-mentioned embodiments are only illustrative of the application of the principles of the present invention. Numerous modifications and alterations may be made by those skilled in the art without departing from the spirit and scope of the invention, and the appended claims are intended to cover such modifications and alterations.

What is claimed is:

1. A three-conductor type filter comprising, two dielectric substrates which are stacked to each other, a stripline pattern resonator including a plurality of juxtaposed resonator conductors and disposed on the surface of one of said dielectric substrates which is brought into contact with the other dielectric substrate, outer conductor layers each formed on each of said dielectric substrates so that each outer conductor layer surrounds the outer surface and side portion of a respective said dielectric substrate, said outer conductor layer formed on said one dielectric substrate being connected to one of the ends of said juxtaposed resonator conductors, and openings each provided on the lateral portions of said outer conductor layers in spaced alignment to said one end of each resonator conductor and perpendicular to the longitudinal direction of the respective resonator conductor for lowering the frequency of response of the filter.

2. A three-conductor type filter device as claimed in claim 1, wherein said each opening is provided with a removable conductor strip for increasing the frequency of response of the filter.

3. A three-conductor type filter device as claimed in claim 1, wherein said resonator conductors of the stripline pattern resonator are arranged in an interdigitated configuration.

4. A three-conductor type filter device as claimed in claim 1, wherein said resonator conductors of the stripline pattern resonator are arranged in a comb configuration, and the one ends of the resonator conductors are connected to the same edge portion of said outer conductor layer formed on said one dielectric substrate.

5. A three-conductor type filter device as claimed in claim 1, including a casing surrounding said filter, and said casing having an inner height equal to the thickness of an assembly of said two dielectric substrates, said stripline pattern resonator and said outer conductor layers.

6. A three-conductor type filter comprising, two dielectric substrates which are stacked to each other, a stripline pattern resonator including a plurality of juxtaposed resonator conductors and disposed on the surface of one of said dielectric substrates which is brought into contact with the other dielectric substrate, outer conductor layers each formed on each of said dielectric substrates so that each outer conductor layer surrounds the outer surface and side portion of a respective said dielectric substrate, said outer conductor layer formed on said one dielectric substrate being connected to one of the ends of said juxtaposed resonator conductors, openings each provided on the lateral portions of said outer conductor layers adjacent to said one end of each resonator conductor for lowering the frequency of response of the filter, a casing surrounding said filter, said casing having an inner height equal to the thickness of an assembly of said two dielectric substrates, said stripline pattern resonator and said outer conductor layers, and an inner length equal to the length of said assembly, and each of said two dielectric substrates is recessed at the portions exposed through said openings.

7. A three-conductor type filter comprising, two dielectric substrates which are stacked to each other, a stripline pattern resonator including a plurality of juxtaposed resonator conductors and disposed on the surface of one of said dielectric substrates which is brought into contact with the other dielectric substrate, outer conductor layers each formed on each of said dielectric substrates so that each outer conductor layer surrounds the outer surface and side portion of a respective said dielectric substrate, said outer conductor layer formed on said one dielectric substrate being connected to one of the ends of said juxtaposed resonator conductors, openings each provided on the lateral portions of said outer conductor layers adjacent to said one end of each resonator conductor for lowering the frequency of response of the filter, a casing surrounding said filter, said casing having an inner height equal to the thickness of an assembly of said two dielectric substrates, said stripline pattern resonator and said outer conductor layers, and an inner length equal to the length of said assembly, and is provided with outwardly protruded portions each positioned opposite to an associated opening of said openings, each of said protruded portions defining an inner space for preventing contact between the portion of said dielectric substrates exposed through said opening and the inner surface of said casing.

* * * * *